United States Patent [19]

Krczal

[11] Patent Number: 4,487,175

[45] Date of Patent: Dec. 11, 1984

[54] CYLINDER HEAD FOR INTERNAL COMBUSTION ENGINE

[75] Inventor: Robert Krczal, Solingen, Fed. Rep. of Germany

[73] Assignee: Klöckner-Humboldt-Deutz AG, Cologne, Fed. Rep. of Germany

[21] Appl. No.: 338,057

[22] Filed: Jan. 8, 1982

[30] Foreign Application Priority Data

Jan. 13, 1981 [DE] Fed. Rep. of Germany ..... 3100755

[51] Int. Cl.[3] ..... F02F 1/26

[52] U.S. Cl. ..... 123/193 H; 123/669

[58] Field of Search ..... 123/193 R, 193 H, 193 CH, 123/193 C, 667, 668

[56] References Cited

U.S. PATENT DOCUMENTS

| | | | |
|---|---|---|---|
| 3,316,888 | 5/1967 | Bachle | 29/156.4 R |
| 3,830,209 | 8/1974 | Jones et al. | 123/193 H |
| 4,254,621 | 3/1981 | Nagumo | 123/193 H |
| 4,337,735 | 7/1982 | Lichtner et al. | 123/193 H |

FOREIGN PATENT DOCUMENTS

| | | | |
|---|---|---|---|
| 1426122 | 3/1969 | Fed. Rep. of Germany . | |
| 2059219 | 6/1972 | Fed. Rep. of Germany . | |
| 2061930 | 7/1972 | Fed. Rep. of Germany ... | 123/193 H |
| 2838797 | 4/1980 | Fed. Rep. of Germany . | |
| 0731013 | 4/1980 | U.S.S.R. ..... | 123/193 H |

*Primary Examiner*—Craig R. Feinberg

*Attorney, Agent, or Firm*—Watson, Cole, Grindle & Watson

[57] ABSTRACT

An aluminum cylinder head for an internal combustion engine has a layer of material of dispersion-hardened sintered aluminum disposed in its bottom wall which forms a combustion chamber wall, the layer comprising an insert or inserts at the sealing surface which delimits the combustion chamber and at the bridge between the intake and exhaust ports in the head for increasing the resistance of the head member to thermal shock at the bridge and for retaining for the sealing surface a high residual hardness at elevated temperatures.

7 Claims, 4 Drawing Figures

CYLINDER HEAD FOR INTERNAL COMBUSTION ENGINE

BACKGROUND OF THE INVENTION

This invention relates generally to a cylinder head of aluminum alloy for an internal combustion engine, including a head member having a bottom wall forming a combustion chamber wall and having a pair of spaced ports for the intake and exhaust valves and an opening for an injection nozzle and/or an ignition aid, the bottom wall having a sealing surface which delimits the combustion chamber wall, and the head member including a wall portion defining a bridge between the spaced ports.

The stress of the cylinder head in the area of the combustion chamber wall and in the sealing surface region between the cylinder head and the cylinder barrel, makes two contradictory demands on the cylinder head material. The bridge between the gas exchange valves must have an increased resistance to thermal shock and deformation, whereas the sealing surface must retain a high residual hardness (compressive creep strength) at elevated temperatures.

In today's high-performance engines, temperatures from 280° to 300° C. are present at the wall portion of the cylinder head which defines a bridge between the intake and exhaust ports. When all constructional measures to optimize the cooling have been exhausted, deliberate upratings of internal combustion engines produce a higher thermal load on the cylinder heads, particularly in the area of the bridge between the intake and exhaust ports. Heat resistance alloys of cast aluminum which have been used can no longer withstand these temperatures for long periods of time especially when the thermal stress of the combustion chamber exceeds 300° C. As shown by German published application No. 142 6 122, it is known to introduce inserts of a material having a high heat resistance, such as steel or a cast high-alloy graphite, into the bottom wall or lid portion of the cylinder head forming the combustion chamber wall so as to increase the thermal loading capability thereof. However, due to different thermal expansions of the inserts relative to that of the cylinder head, the bond therebetween deteriorates after a period of time and results in serious damage of the engine. Moreover, the weight of the aluminum cylinder head must be appreciably increased in order to render it compatible with such inserts.

And, in the regions of the sealing surface, particularly at the exhaust port area, high temperatures effect a considerable reduction in the hardness which had been achieved through precipitation hardness aging, even for those alloys of cast aluminum known for their high-temperature strength. As a result, the compressive creep resistance of the cylinder head in the region of the sealing surface lessens and results in leakage between the cylinder head and the cylinder barrel. Inserts of other materials cast into the region of the sealing surface or mechanically fastened therein, as set forth in German published applications No. 205 9 219 and 283 8 797, possess the same drawbacks as discussed with reference to the aforementioned German published application.

SUMMARY OF THE INVENTION

It is therefore an object of the present invention to improve upon the mechanical properties of an aluminum cylinder head, particularly it's heat resistance quality, in such a manner that, with the same lifespan, a higher efficiency is achieved or, with the same performance, a higher lifespan is accomplished.

This general objective is achieved according to the invention in that the bottom wall of the cylinder head forming the combustion chamber wall comprises a layer of material of dispersion-hardened sintered aluminum disposed at the bridge between the intake and exhaust ports, and at the sealing surface which delimits the combustion chamber wall. Since the cylinder head and this layer of material are of the same basic material and, therefore, have the same thermal expansion coefficient, the bond therebetween will not deteriorate as the result of dissimilar thermal expansions. The weight of the aluminum cylinder head as thereby reinforced is not greater than an aluminum cylinder head cast in the conventional manner. And, compressive creep resistance and thermal shock resistance of dispersion-hardened aluminum sintered materials are greater, even when subjected to a thermal stress which is 50° C. higher than which the present internal combustion engines experience, than in the known alloys of cast aluminum with heat-resistant characteristics.

DETAILED DESCRIPTION OF THE INVENTION

Figure 1:
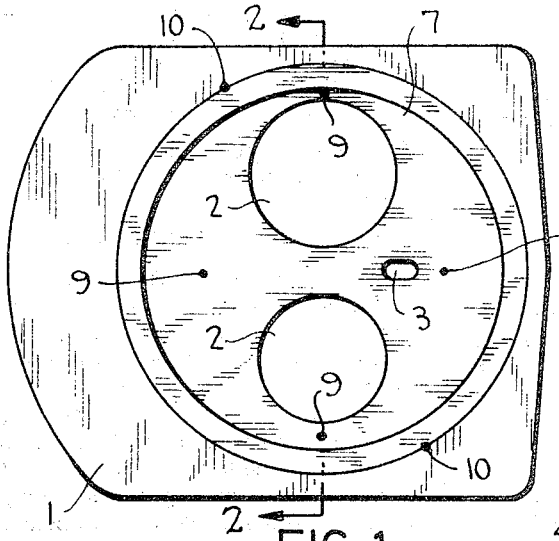
FIG. 1 is a bottom plan view of the cylinder head according to the invention having a monolithic combustion chamber/sealing surface insert.

Turning now to the drawings wherein like reference characters refer to like and corresponding parts throughout the several views, a cylinder head member 1 of aluminum alloy for an internal combustion engine has a pair of spaced intake and exhaust ports 2 provided therein in a basically conventional manner and in communication with valve seats in the bottom wall or lid portion of the head which forms a combustion chamber wall as it covers the open top of the combustion space in an adjoining cylinder barrel (not shown). Also, an opening 3 is provided in the cylinder head for an injection nozzle (not shown) and/or for an ignition aid (not shown) in the customary manner. The bottom wall, generally designated 4, of the cylinder head has a sealing surface 5 providing a sealing engagement with a corresponding surface of the cylinder barrel. Such sealing surface delimits the combustion chamber wall in the normal manner. And, the head member includes a wall portion 6 defining a bridge between the intake and exhaust ports.

Figure 2:
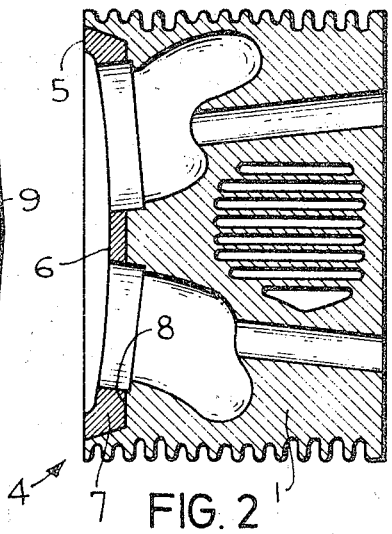
FIG. 2 is a sectional view taken substantially along the line 2—2 of FIG. 1.

In accordance with the invention, as shown in the FIGS. 1 and 2 embodiment, bottom wall 4 of the cylinder head is defined by a monolithic combustion chamber/sealing surface insert or layer 7 comprising a layer of material of dispersion-hardened sintered aluminum disposed at bridge 6 and at sealing surface 5. The cylinder head is undercut as at 8 for the reception of the layer 7 of material which may be fixed in place in several different ways. For example, the undercut portion may form a mold cavity having a thickness equal to the intended thickness of layer 7 so as to facilitate casting of the dispersion-hardened sintered aluminum in place. Or, the undercut portion may form a cavity equal to the thickness of a preformed layer 7 but being slightly less than the overall dimension of such preformed layer so as to facilitate a press fit of the material in place. Otherwise, layer 7 may be fastened in place in some manner as at 9, or the layer may be joined as at 10 to the cylinder head by means of an electron beam, a laser beam or via some other welding process.

Figure 3:
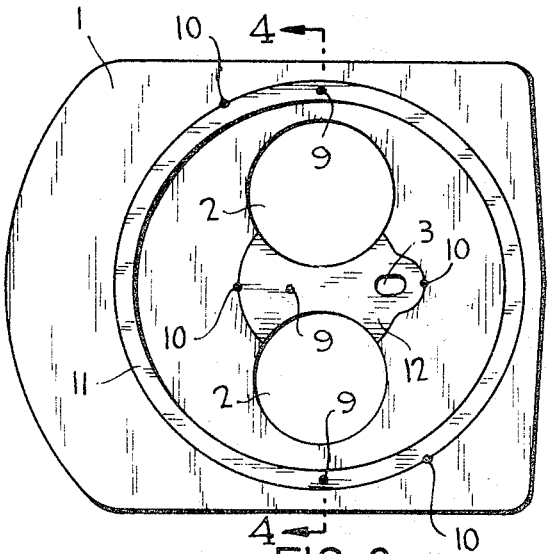
FIG. 3 is a bottom plan view of another embodiment of the cylinder head according to the invention having separate inserts for the bridge between the intake and exhaust ports and for the sealing surface.
Figure 4:
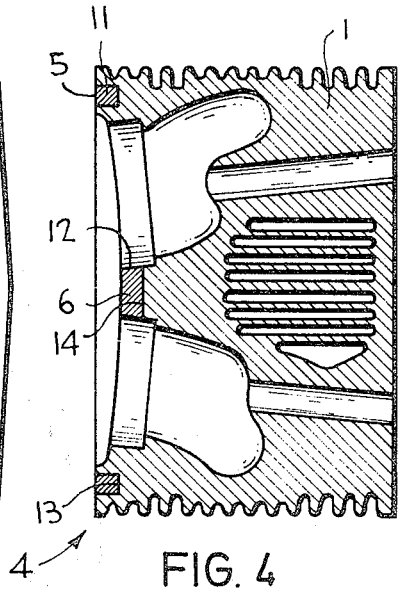
FIG. 4 is a sectional view taken substantially along the line 4—4 of FIG. 3.

In another embodiment according to the invention, shown in FIGS. 3 and 4, layer 7 of dispersion-hardened sintered aluminum may be in the form of a sealing surface insert 11 and a separate bridge insert 12. Similarly as described with reference FIGS. 1 and 2, the cylinder head may be undercut, in this case as at 13 and as at 14, to respectively accommodate the sealing surface insert and the bridge insert. The dispersion-hardened sintered aluminum layer forming these inserts may be cast in place or otherwise press fit, fastened or welded in place in the same manner as described with reference to FIGS. 1 and 2.

The improved cylinder head according to the invention as aforedescribed provides increased resistance to thermal shock at the bridge between the intake and exhaust ports, and the sealing surface retains a high residual hardness at elevated temperatures. And, due to the same thermal expansion coefficient of material 7 and that of the remainder of cylinder head 1, any tendency of separation therebetween upon increases in thermal loads is substantially avoided. And, the separate sealing surface and bridge inserts may include different dispersoids to respectively effect the desired high residual hardness and the resistance to thermal shock characteristics.

And, the present invention permits cylinder head 1 to be made from a less thermally stable, more readily pourable, aluminum alloy that need not be age hardened by exposure to high temperatures. In addition to the pouring advantages, which simplify the processing, the use of such less thermally stable aluminum alloys reduce cost or materials. And, the monolithic of separate inserts which form a layer of dispersion-hardened sintered aluminum for the purpose and in the manner aforedescribed, permit use of such inserts in cylinder heads of materials other than aluminum, such as grey cast iron, without departing from the invention.

Obviously, many modifications and variations of the present invention are made possible in the light of the above teachings. It is therefore to be understood that within the scope of the appended claims the invention may be practiced otherwise than as specifically described.

What is claimed is:

1. A cylinder head of aluminum alloy for an internal combustion engine, comprising a head member having a bottom wall forming an internal combustion chamber wall and having a pair of spaced ports for gas exchange valves and an opening for the reception of one of an injection nozzle and an ignition aid, said bottom wall having a sealing surface along its lower periphery which delimits said combustion chamber wall, and said head member including a wall portion defining a bridge between said ports including said opening, the improvement wherein said bottom wall comprises a first insert of material consisting essentially of dispersion-hardened sintered aluminum solely disposed at said bridge, and comprises a second insert of material of dispersion-hardened sintered aluminum solely disposed at said sealing surface, whereby resistance of said head member to thermal shock at said bridge is increased, said sealing surface retains a high residual hardness at elevated temperatures, and due to the same thermal expansion coefficient of said inserts and of the remainder of said head member any tendency of separation therebetween upon increases in thermal loads is substantially avoided.

2. The cylinder head according to claim 1, wherein said sintered aluminum of said first and second inserts include different dispersoids to respectively effect said high residual hardness and said resistance to thermal shock.

3. The cylinder head according to claim 1, wherein said head member has an undercut portion forming a mold cavity substantially equal to the thickness of said layer to facilitate casting said material in place.

4. The cylinder head according to claim 1, wherein said head member has an undercut portion forming a cavity substantially equal to the thickness of said layer and slightly less than the overall dimension of said layer to facilitate a press fit of said material in place.

5. The cylinder head according to claim 1, wherein said layer is fastened to said head member.

6. The cylinder head according to claim 1, wherein said layer is welded in place on said head member.

7. The cylinder head according to claim 1, wherein said head member consists of a readily pourable, low heat resistant and non-aged aluminum alloy.

* * * * *